US010477980B2

(12) United States Patent
Feltrin

(10) Patent No.: US 10,477,980 B2
(45) Date of Patent: Nov. 19, 2019

(54) COVERED FURNISHING ELEMENTS AND METHODS OF MAKING SAME

(71) Applicant: ARPER S.p.A., Monastier di Treviso, Treviso (IT)

(72) Inventor: Claudio Feltrin, Treviso (IT)

(73) Assignee: ARPER S.p.A., Monastier di Treviso, Treviso (IT)

( * ) Notice: Subject to any disclaimer, the term of this patent is extended or adjusted under 35 U.S.C. 154(b) by 846 days.

(21) Appl. No.: 15/097,296

(22) Filed: Apr. 13, 2016

(65) Prior Publication Data

US 2016/0296033 A1 Oct. 13, 2016

(30) Foreign Application Priority Data

Apr. 13, 2015 (IT) ..... PD2015A0077

(51) Int. Cl.

| | |
|---|---|
| ***A47C 31/02*** | (2006.01) |
| ***A47B 13/08*** | (2006.01) |
| ***B68G 7/00*** | (2006.01) |
| *A47G 11/00* | (2006.01) |
| *A47G 1/06* | (2006.01) |

(52) U.S. Cl.

CPC ..... *A47C 31/023* (2013.01); *A47B 13/08* (2013.01); *B68G 7/00* (2013.01); *A47G 11/004* (2013.01); *A47G 2001/0661* (2013.01); *Y10T 428/24008* (2015.01)

(58) Field of Classification Search

CPC ..... Y10T 428/24008; A47C 31/023; A47G 2001/0661

See application file for complete search history.

(56) References Cited

U.S. PATENT DOCUMENTS

| | | | |
|---|---|---|---|
| 2,637,136 | A | 5/1953 | Mark |
| 3,557,856 | A | 1/1971 | Berman |
| 3,657,796 | A | 4/1972 | Gochnauer |

FOREIGN PATENT DOCUMENTS

| | | | |
|---|---|---|---|
| WO | 2007123394 | A1 | 11/2007 |

OTHER PUBLICATIONS

Italian Search Report I0 55436 IT PD20150077—dated Nov. 17, 2015.

*Primary Examiner* — Alexander S Thomas
(74) *Attorney, Agent, or Firm* — Merchant & Gould P.C.

(57) ABSTRACT

Furnishing elements which include a frame having at least a first and a second wall incident to each other so as to identify an edge, at least one covering associated with and superposed on said frame so as to cover at least partially said walls and said edge are provided. The frame, in correspondence with said edge, may include an attachment element which delimits an attachment seat open in the vicinity of said first and second wall, wherein the covering includes at least two flaps folded and inserted inside the attachment seat, and wherein said attachment seat locks the flaps on the inside against the inner walls of the seat itself. Corresponding methods for covering furnishing elements are also provided.

14 Claims, 6 Drawing Sheets

COVERED FURNISHING ELEMENTS AND METHODS OF MAKING SAME

CROSS-REFERENCE TO RELATED APPLICATION

This application claims priority to and benefit of Italian Patent Application No. PD2015A000077 (which corresponds to Italian Patent Application No. 102015902343877 under the new numbering system which was introduced in 2015 with the implementation of the IPTO online filing platform) filed Apr. 13, 2015, the contents of which are incorporated by reference in their entirety.

FIELD OF THE INVENTION

This invention relates to covering furnishing elements and methods for covering furnishing elements.

BACKGROUND OF THE INVENTION

In the field of furnishing elements, it is known to cover them with coverings or sheets of fabric, leather or similar materials according to users' needs.

The covering step is quite delicate and usually must be performed manually by skilled workers.

Typically a furnishing element is placed on the covering layer, on the inner side of the layer itself, and then portions or flaps of the covering layer are folded on the furnishing element and fixed thereto, for example, by means of staples, nails, glue or similar attachment means. Excess portions of flaps are then cut away.

Such covering methods present certain issues when corners or edges of the furnishing element must be covered.

In fact, the covering of the edges must be done with great care to prevent the fabric from forming unsightly folds and wrinkles that, in the eyes of the user, would be unacceptable.

If one considers that the covering is often leather, and similar fine materials, is in fact essential that the manual operation be extremely accurate and precise.

Among other things, the use of leather and similar materials further complicates the covering operations especially when using materials that are thicker than, for example, a common fabric.

To date, solutions for covering corners often have inaccuracies or imperfections due to unsightly wrinkles or overlapping portions that are not very elastic.

Therefore, typical solutions involve disadvantages in terms of precision and finish as well as costs, and time.

Therefore, there is a need to solve the drawbacks and limitations mentioned in reference to the prior art.

That is to say, there is a need to develop a furnishing element and a corresponding covering method that is precise and accurate, in particular at critical points or edges, and that is also fast and economical to produce.

SUMMARY OF THE INVENTION

This need is met by the present invention which provides furnishing elements which may include a frame having at least a first and a second wall incident to each other so as to identify a edge, at least one covering associated with and superposed on said frame so as to cover at least partially said walls and said edge, wherein the frame, at said edge, includes an attachment element which delimits an attachment seat open in the vicinity of said first and second wall, wherein the covering includes at least two flaps folded and inserted inside the attachment seat, said attachment seat blocking the flaps inside it against inner walls of said seat.

Covering methods are also provided which may include the steps of:

- providing a furnishing element which includes a frame having at least a first and a second wall incident to each other so as to identify an edge,
- wherein the frame, at said edge, includes an attachment element which delimits an attachment seat open in the vicinity of said first and second wall,
- providing at least one covering to associate with said frame so as to cover at least partially said walls and said edge,
- associating and superposing the covering on the frame and on said edge, so as to have an inner side of the covering in contact with the frame,
- folding at least two flaps of the covering and inserting them inside the attachment seat, placing the inner side of the flaps of the covering in contact with the inner walls of said attachment seat, and
- blocking the flaps of the covering inside the attachment seat.

Further characteristics and advantages of this invention will be more understandable from the following description of its preferred and non-limiting examples of embodiments.

BRIEF DESCRIPTION OF THE FIGURES

FIGS. 6 to 8 are plan views of attachment elements applied to furnishing elements according to embodiments of the;

DETAILED DESCRIPTION

Figure 1:
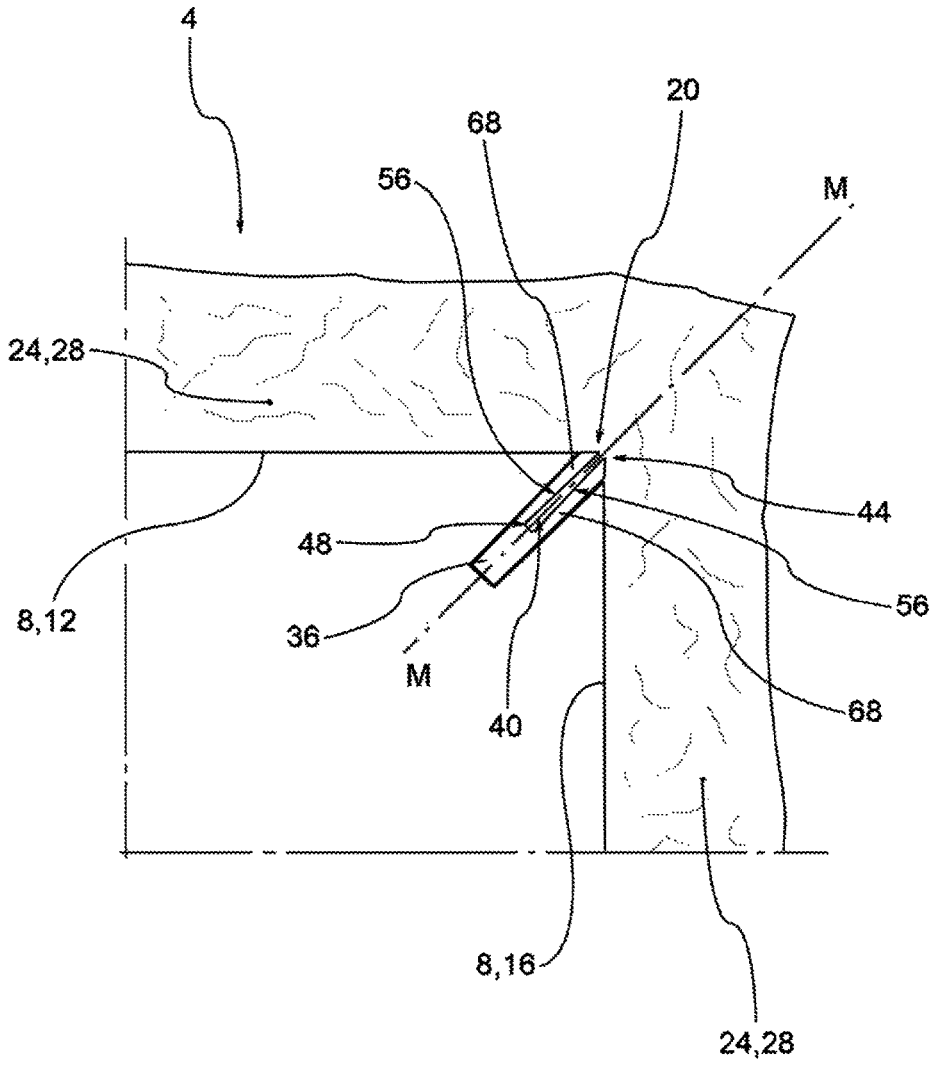
FIGS. 1 to 5 are views of successive steps of covering a furnishing element according to an embodiment of the invention.

The elements, or parts of elements, in common between the embodiments described below will be indicated with the same reference numbers.

With reference to the Figures, reference number 4 globally indicates a partial schematic view of a furnishing element according to the invention.

For the purposes of the invention, it should be noted that the term furnishing element must be considered in a broad sense, comprising any furnishing component, such as for example a sofa, a cushion, a chair, a table, a bed, a piece of furniture in general, a wall-mounted decorative element, suitable for covering, as described in more detail below.

Furnishing element 4 may include a frame 8 having at least a first and a second wall 12,16 incident to each other so as to identify an edge 20.

The frame may have any size and shape and may be made of any material.

The first and the second wall 12,16, may be flat but may also have non-planar geometries.

Furthermore, the first and second wall 12,16 may be incident to one another so as to form an edge 20, at any angle of incidence; in other words the walls 12,16 need not necessarily be orthogonal to each other, but can be angled with each other according to various angles of incidence in certain non-limiting embodiments of the invention.

The furnishing element 4 also may include at least one covering 24 associated with and superposed on said frame 8 so as to cover at least partially said first and second wall 12,16 and said edge 20.

The covering 24 may be of any type, shape and size; typically it is a leather or imitation leather covering, but the term covering 24 may include any flexible layer suitable to cover the furnishing element, and therefore may include woven and non-woven fabrics, synthetic coverings and so on.

The covering 24 may include an inner side 28, intended to interface in contact with the frame 8 and the portions of the furnishing element 4 to be covered, in which said inner side 28, in the covering configuration of the furnishing element 4 is not visible to an observer. The covering 24 also may include an outer side 32, opposite to said inner side, so as to be visible to an observer in the covering configuration of the furnishing element 4.

Advantageously, the frame 8, at said edge 20, may include an attachment element 36 which delimits an attachment seat 40 open in the vicinity of said first and second wall 12,16.

In other words, the attachment seat 40 of the attachment element 36 may extend from an opening 44 in the vicinity of the edge 20, in correspondence of which it is open, toward an inner bottom 48, on the side opposite to the opening 44, in correspondence of which it is closed.

The covering 24 may include at least two flaps 52 folded and inserted inside of the attachment seat 40, so that the attachment seat 40 locks the flaps 52 on the inside against the inner walls 56 of the seat itself.

For example, said inner walls 56 of the attachment seat 40 may be inner side walls arranged facing each other and extending in a direction substantially parallel to that of the corresponding edge 20.

According to certain embodiments of the invention, the attachment element 36 is made integrally at the edge 20 defined by said first and second wall 12,16 of the frame 8. For example, in such embodiments, the attachment seat 40 is formed on the first and second wall 12,16 of the frame 8 of milling or, in any case, through the removal of material from the walls themselves so as to obtain the attachment seat 40 directly on the walls themselves.

In certain embodiments of the invention, the attachment element 36 may be an applied element and joined to the walls 12,16 of the frame 8 at the edge 20 identified thereby.

For example, in such embodiments, the attachment element 36 is an insert, initially separate from the frame, and may be made of different material from that of the frame 8. It then may be inserted between the first and the second wall 12,16 of the frame 8 in correspondence of said edge 20. The insert may be anchored to the walls 12,16 of the frame 8 in various ways, for example, by interlocking, or by attachment elements such as screws, staples, nails, rivets, glues and the like.

In certain embodiments of the invention, said inner walls 56 of the attachment seat 40 may be provided with teeth 60 suitable for blocking the flaps 52 of the covering 24 folded inside the attachment seat 40.

The attachment seat 64 may have a width that decreases moving away from the edge 20 towards the inner bottom 48 of the attachment seat 40 itself so as to oppose the extraction of the flaps 52 from the attachment seat 40. The width 64 can be understood as a distance measured between opposite inner walls 56 of the attachment seat 40, in a direction perpendicular to a centreline plane M-M of the attachment seat, said centreline plane extending along a prevailing extension direction of the attachment seat 40 from the edge 20 towards the inner bottom 48.

The width 64 of the attachment seat 40 may have an initial value, at the aperture 44 of the seat itself, not less than the sum of the thicknesses of said flaps 52 of the covering 24 inserted in said seat, so as to facilitate the insertion of the flaps 52 in the seat 40.

As a result, the width 64 of the attachment seat 40 may have a value, moving towards the inner bottom 48, less than the sum of the thicknesses of said flaps 52, so as to allow the interlocking of the flaps 52 inside the seat 40. In other words, the narrowing of the attachment seat 40 allows gripping of the flaps 52 between its internal walls 56.

In certain embodiments, the attachment element 36 may include two tabs 68 facing each other which delimit the inner walls 56 of said attachment seat 40 and which extend as far as the edge 20.

For example, said tabs 68 may be flexible and the attachment element 36 may include closure means 72 for said tabs 68. In this way it is possible, through closure means 72 that bring the tabs 68 together, to lock or grip the flaps 52 between the inner walls 56 of the tabs 68.

Portions of the covering 24 adjacent to the edge 20 may be fixed to the frame 8 by means of locking elements 76 such as staples, nails, adhesives and similar.

We turn now to methods of covering a furnishing element according to the invention.

In certain embodiments, the method may include the steps of:

- providing a furnishing element 4 which includes a frame 8 having at least a first and a second wall 12,16 incident to each other so as to identify an edge 20,
- wherein the frame 8, at said edge 20, may include an attachment element 36 which delimits an attachment seat 40 open in the vicinity of said walls 12,16,
- providing at least one covering 24 to associate with said frame 8 so as to cover at least partially said first and second wall 12,16 and said edge 20,
- associating and superposing the covering 24 on the frame 8 and on said edge 20, so as to have an inner side 28 of the covering 24 in contact with the frame 8,
- folding at least two flaps 52 of the covering 24 and inserting them inside the attachment seat 40 (FIGS. 2 to 3), placing the inner side 28 of the flaps 52 of the covering 24 in contact with the inner walls 56 of said attachment seat 40, and
- blocking the flaps 52 of the covering 24 inside the attachment seat 40.

The step of preparing the attachment element 36 can occur, as seen, by forming the attachment element 36 integrally at the edge 20 defined by said first and second wall 12,16.

Alternately, the attachment element 36 can be an applied element and joined to the walls 12,16 of the frame 8 at the edge 20 identified thereby.

Figure 2:
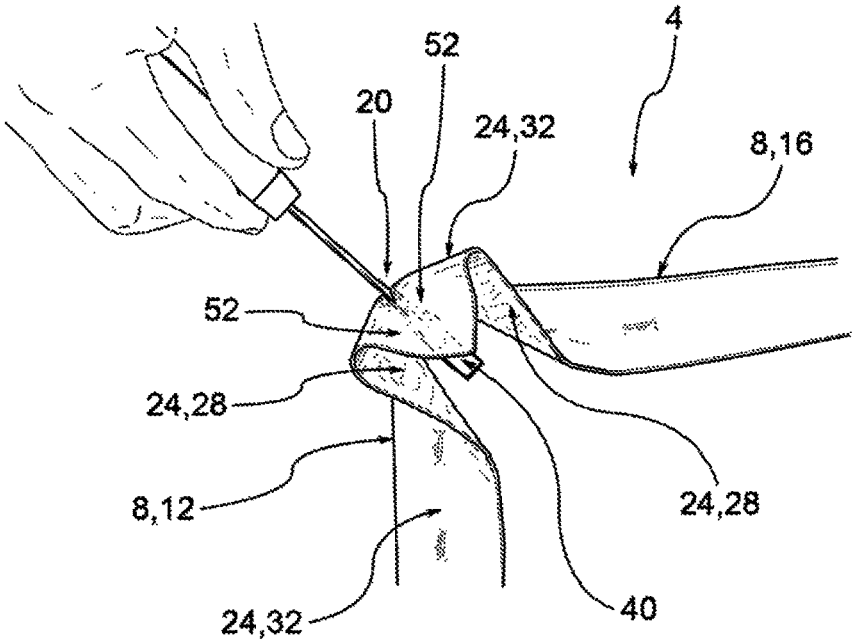
Figure 3:
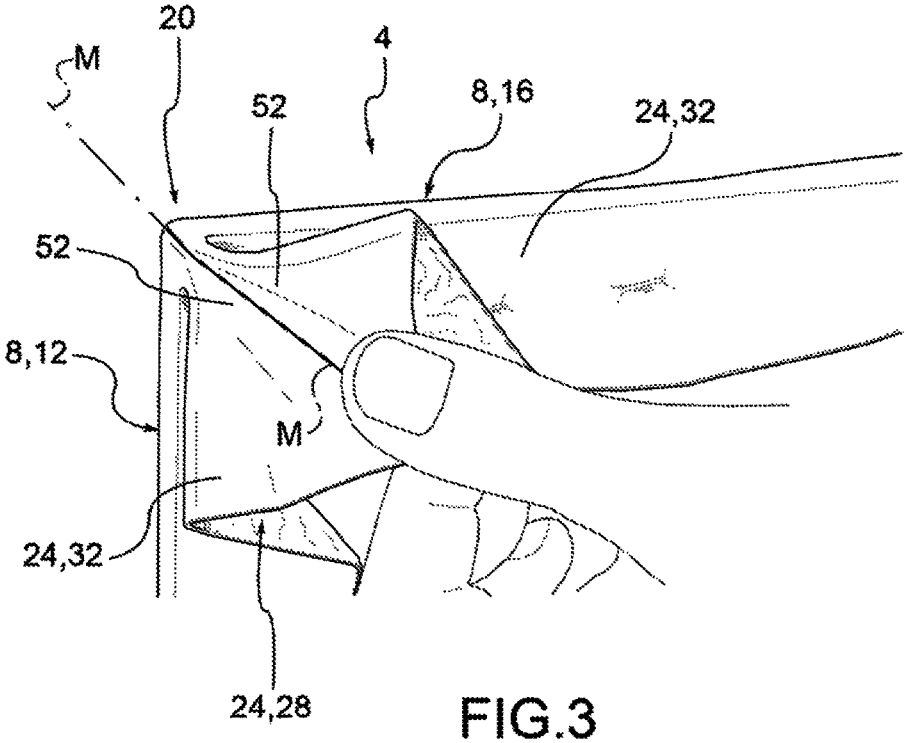

The step of inserting the flaps 52 of the covering 24 inside the attachment seat 40 may be carried out using a tool resting on the flaps 52 on an outer side 32 of the covering 24, opposite said inner side 28, and inserted gradually inside the attachment seat 40 (FIG. 2).

Said tool may be, for example, a spatula, in order to accompany the insertion of the flaps 52 along the whole thickness of the walls 12,16.

Such methods also may include the step of equipping the attachment element 36 with two tabs 68 facing one another which delimit the inner walls 56 of said attachment seat 40 which extend to the edge 20, to provide for the step of equipping the attachment element 36 with closure means 72 of the tabs 68 (FIG. 7), in which the step of locking of the flaps 52 of the covering 24 in the attachment seat 40 includes the step of actuating the closure means 72 of the tabs 68 by gripping and fixing the flaps 52 in contact with the tabs themselves.

Figure 7:
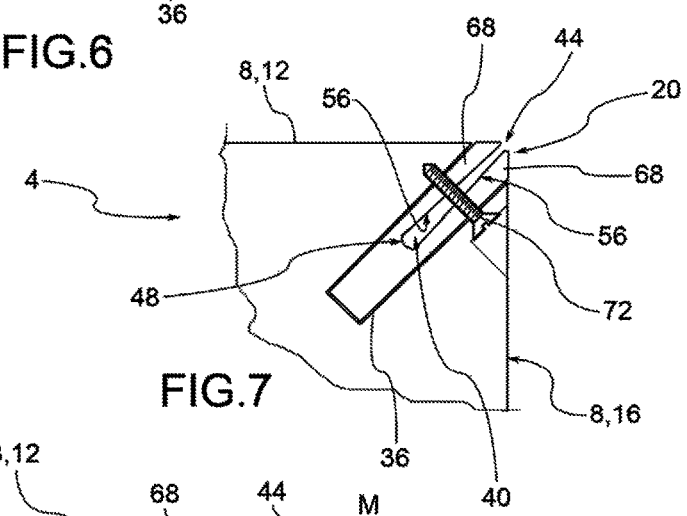
Figure 8:
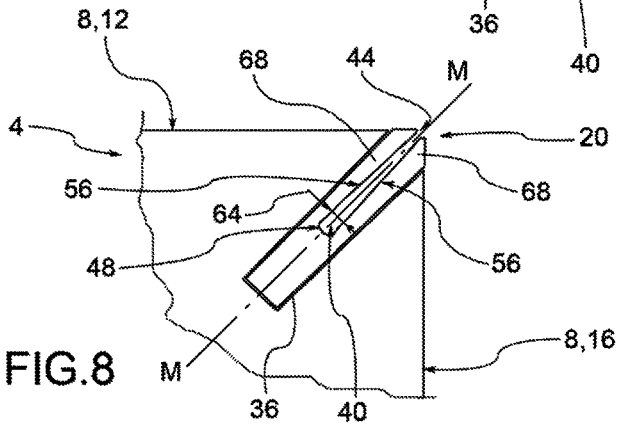
Figure 9:
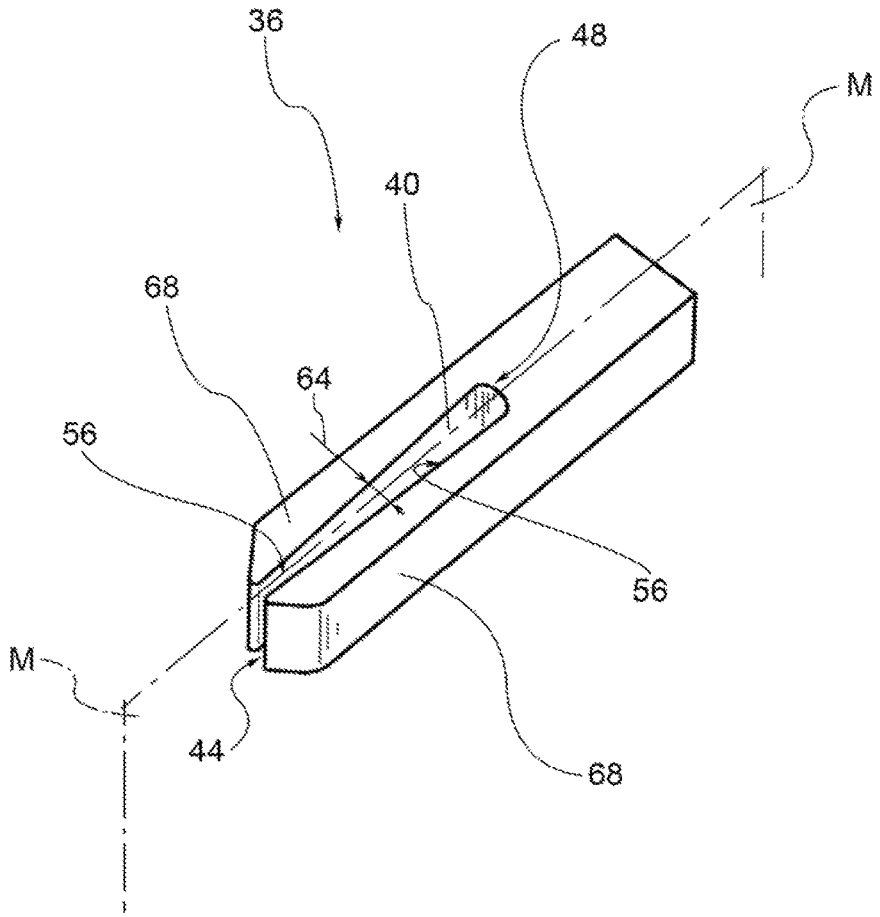
FIG. 9 is a perspective view of an attachment element applied to a furnishing element, according to an embodiment of the invention.

FIG. 7 shows a screw as one such example of closure means 72; this representation is not to be considered in any way exhaustive of all the possible embodiment variants of such closure means 72 as any suitable element for closure may be used.

Figure 4:
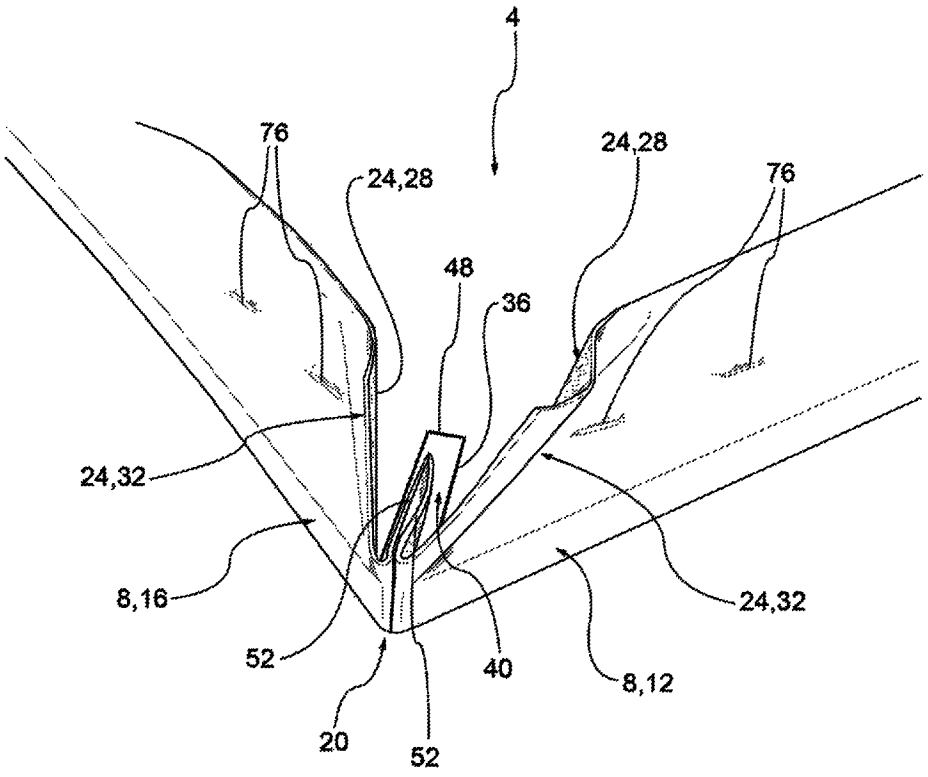
Figure 5:
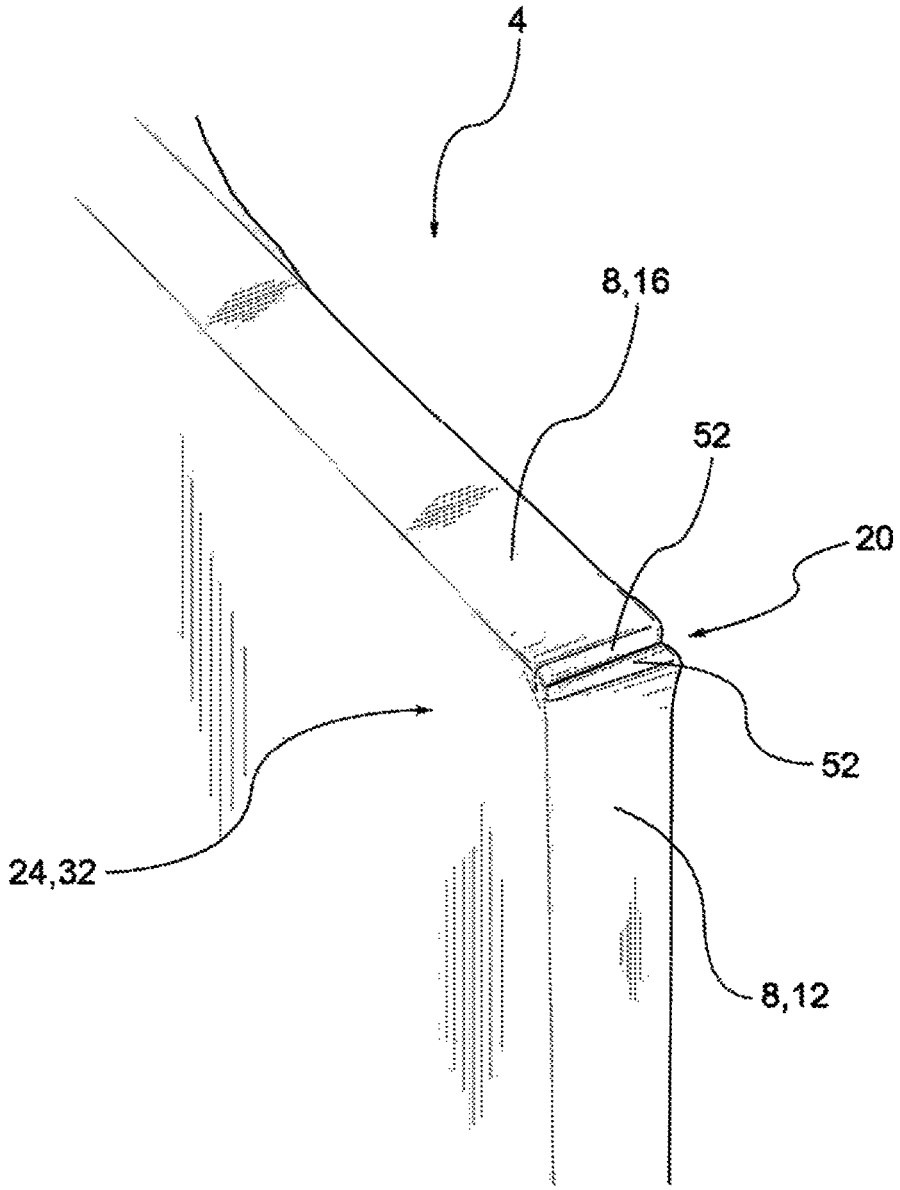
Figure 6:
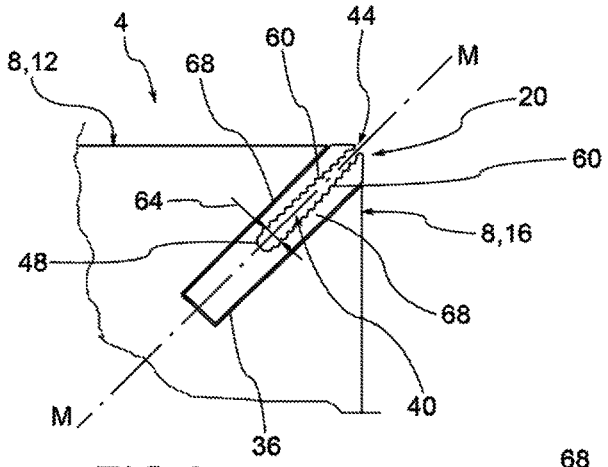

Finally, methods according to the invention may include the step of attaching to the frame 8 portions of the covering 24 adjacent to the edge 20 through the use of locking means 72 such as staples, nails, adhesives and the like (FIG. 4).

The final result of coverings of a furniture element 4 according to the invention, with particular reference to covering 24 of the edges 20, provides flaps 52 of covering 24 that are turned up towards the inside of the edge 20 which acquires, from an aesthetic point of view, an introflexed profile.

As can be appreciated from the description, this invention overcomes the drawbacks of the prior art.

In particular, the attachment element allows stretching and locking the flaps of the covering in a precise and durable manner. In fact the operator can insert the flaps of the covering in the attachment seat quickly and then lock them in place, so that these remain taut, without wrinkles. Moreover, thanks to the positioning of the flaps inside the attachment seat, one avoids overlapping of the flaps in correspondence of the edges to be covered, as is the case in prior art solutions.

The covering of the edges, from an aesthetic point of view, is precise and clean, without any wrinkle or blemish.

Furthermore, the covering of the edges, thanks to the use of the attachment element, provides a repeatable result, not linked to the precision of the operator. As a result, it is possible to cover all the edges and always obtain the same aesthetic results, regardless of the specific skill of the operator.

Finally, the attachment element ensures the correct traction of the covering flaps so that these will not come loose over time.

Moreover, unlike previous solutions, thanks to the insertion of the flaps inside the attachment seat, one avoids that the flaps themselves may overlap each other or, in any case, form unsightly thickening of the covering in correspondence of the edges themselves.

Thus, in a totally innovative way, the invention allows the edges of the furnishing element to be covered by flaps turned towards the inside of the attachment seat, arranged in correspondence of the edges themselves.

A person skilled in the art, in order to satisfy contingent and specific needs, may make numerous modifications and variations to the furnishing elements and covering methods described above, all of which however should be considered to be within the scope of the invention as described and claimed herein.

What is claimed is:

1. A furnishing element comprising:

a frame having at least a first wall and a second wall incident to each other so as to define an edge, at least one covering associated with and superposed on said frame so as to cover at least partially said first wall and said second wall and said edge, wherein the frame, at said edge, comprises an attachment element which delimits an attachment seat open in the vicinity of said first wall and said second wall, wherein the covering comprises at least two flaps folded and inserted inside the attachment seat, wherein said attachment seat blocks the flaps inside said attachment seat against inner walls of said attachment seat; and wherein the attachment element is an applied element and is joined to the first and second walls of the frame at the edge identified thereby.

2. The furnishing element of claim 1, wherein the attachment element is integral with the edge defined by said first and second wall.

3. The furnishing element of claim 1, wherein said inner walls of the attachment seat comprise teeth suitable for blocking the flaps folded inside the attachment seat.

4. The furnishing element of claim 1, in which the attachment seat has a width that decreases moving from an opening at the edge towards an inner bottom of said seat so as to oppose the extraction of the flaps from the attachment seat, the width being a distance measured between opposite inner walls of the attachment seat.

5. The furnishing element of claim 4, wherein the width of the attachment seat has an initial value, at the aperture of the seat, not less than the sum of thicknesses of said flaps of the covering inserted in said seat, so as to facilitate the insertion of the flaps in the attachment seat.

6. The furnishing element of claim 4, wherein the width of the attachment seat has a value, moving towards the inner bottom, less than the sum of thicknesses of said flaps, so as to allow the interlocking of the flaps inside the seat.

7. The furnishing element of claim 1, wherein portions of the covering adjacent to the edge are fixed to the frame by means of a locking element such as staples, nails, adhesives and similar.

8. A furnishing element comprising:

a frame having at least a first wall and a second wall incident to each other so as to define an edge;

at least one covering associated with and superposed on said frame so as to cover at least partially said first wall and said second wall and said edge;

wherein the frame, at said edge, comprises an attachment element which delimits an attachment seat open in the vicinity of said first wall and said second wall;

wherein the covering comprises at least two flaps folded and inserted inside the attachment seat;

wherein said attachment seat blocks the flaps inside said attachment seat against inner walls of said attachment seat; and wherein the attachment element is an applied element and is joined to the first and second walls of the frame at the edge identified thereby;

wherein the attachment element comprises two tabs facing each other which delimit the inner walls of said attachment seat which extend as far as the edge.

9. The furnishing element of claim 8, wherein said tabs are flexible and the attachment element comprises a closure element for said tabs.

10. A method of covering a furnishing element comprising the steps of:

providing a furnishing element comprising a frame having at least a first wall and a second wall incident to each other so as to identify an edge, wherein the frame, at said edge, comprises an attachment element which delimits an attachment seat open in the vicinity of said first wall and said second wall, providing at least one covering to associate with said frame so as to cover at least partially said walls and said edge, associating and superposing the covering on the frame and on said edge, so as to have an inner side of the covering in contact with the frame, folding at least two flaps of the covering and inserting the at least two flaps inside the attachment seat, placing the inner side of the flaps of the covering in contact with inner walls of said attachment seat, and blocking the flaps of the covering inside the attachment seat, wherein the attachment element is an applied element and joined to the walls of the frame at the edge identified thereby.

11. The method of claim 10, wherein the attachment element is made integrally at the edge defined by said first and second wall.

12. The method of claim 10, wherein the step of inserting the flaps of the covering inside the attachment seat comprises a tool resting on the flaps on an outer side of the covering, opposite said inner side, and gradually inserting the tool inside the attachment seat.

13. The method of claim 10, in which the step of fitting the attachment element with two tabs facing each other which define the inner walls of said attachment seat and which extend to the edge is provided for, wherein the step of fitting the attachment element of the locking means of the tabs is provided for, wherein the step of blocking the flaps of the covering inside the attachment seat provides for the step of actuating the locking means of the tabs to clamp and attach the flaps in contact with said tabs.

14. The method of claim 10, comprises a step of attaching to the frame portions of the covering adjacent to the edge by a locking element such as staples, nails, adhesives and the like.

* * * * *